US009464835B2

(12) United States Patent
Lifson et al.

(10) Patent No.: US 9,464,835 B2
(45) Date of Patent: Oct. 11, 2016

(54) REMOTE SOFTWARE LOADING FOR REFRIGERANT SYSTEM

(75) Inventors: Alexander Lifson, Manlius, NY (US); Michael F. Taras, Fayetteville, NY (US)

(73) Assignee: CARRIER CORPORATION, Syracuse, NY (US)

( * ) Notice: Subject to any disclaimer, the term of this patent is extended or adjusted under 35 U.S.C. 154(b) by 2419 days.

(21) Appl. No.: 12/280,840

(22) PCT Filed: Apr. 25, 2006

(86) PCT No.: PCT/US2006/015359

§ 371 (c)(1),
(2), (4) Date: Aug. 27, 2008

(87) PCT Pub. No.: WO2007/123528

PCT Pub. Date: Nov. 1, 2007

(65) Prior Publication Data

US 2009/0139246 A1 Jun. 4, 2009

(51) Int. Cl.
*F25B 49/00* (2006.01)

(52) U.S. Cl.
CPC ..... *F25B 49/00* (2013.01); *F25B 2600/07* (2013.01)

(58) Field of Classification Search
CPC ..... F25B 49/00; F25B 2600/07
USPC ..... 62/56, 126; 236/51; 700/276
See application file for complete search history.

(56) References Cited

U.S. PATENT DOCUMENTS

| | | | | |
|---|---|---|---|---|
| 6,393,848 | B2 | 5/2002 | Roh et al. | |
| 6,397,606 | B1 | 6/2002 | Roh et al. | |
| 6,708,505 | B2 * | 3/2004 | Nakamura et al. | 62/125 |
| 6,874,692 | B2 * | 4/2005 | Ueda et al. | 236/51 |
| 6,889,510 | B2 | 5/2005 | Song et al. | |
| 2004/0016241 | A1 | 1/2004 | Street et al. | |
| 2004/0060044 | A1 * | 3/2004 | Das et al. | 717/171 |

FOREIGN PATENT DOCUMENTS

| | | | |
|---|---|---|---|
| CN | 2387433 | | 7/2000 |
| CN | 1470834 | | 1/2004 |
| CN | 1682184 | | 10/2005 |
| DE | 20207547 | U1 | 12/2002 |
| JP | 2002303472 | A | 10/2002 |
| WO | 2005020072 | A2 | 3/2005 |

OTHER PUBLICATIONS

Search Report and Written Opinion PCT/US06/15359.
International Preliminary Report on Patentability dated Nov. 6, 2008.

* cited by examiner

*Primary Examiner* — Marc Norman
(74) *Attorney, Agent, or Firm* — Carlson, Gaskey & Olds, P.C.

(57) ABSTRACT

A refrigerant system control software upgrades are remotely downloaded over information carrying media. The software upgrades can be timed to occur when the Internet traffic is low. Once the upgrade has been received, a verification test may be performed for the refrigerant system components affected by the software upgrade. The test is monitored, and the results are sent back to the remote location such that the remote location can ensure the software upgrade was successful.

21 Claims, 1 Drawing Sheet

REMOTE SOFTWARE LOADING FOR REFRIGERANT SYSTEM

This application is a U.S. National Phase application of PCT Application No. PCT/US2006/015359 filed Apr. 25, 2006.

BACKGROUND OF THE INVENTION

This invention relates to a method of downloading software or software updates to control and operate a refrigerant system, from a remote location, such as over the Internet or other information carrying media.

Refrigerant systems are utilized to condition a secondary fluid such as air, water, glycol solution or other media. In one main example, air conditioners or heat exchangers are utilized to change the temperature and/or humidity of air being delivered into an indoor environment to provide comfort.

Air conditioning systems have become the subject of control logic improvements and control feature enhancements. More complex controls have been developed to increase the operational efficiency of the refrigerant systems, and also to achieve and maintain desired conditions in the environment to be conditioned within a precisely defined tolerance band. Thus, sophisticated controls running complex software have become an integral part of many modern refrigerant systems.

As known, the software for such controls requires updates over time, since new algorithms are discovered and software "bugs" are troubleshot. To date, to update the software for a refrigerant system control, a technician has had to visit the location of the refrigerant system. This is time-consuming and undesirable as well as requires equipment shutdown.

SUMMARY OF THE INVENTION

In a disclosed embodiment of this invention, a control for a refrigerant system is provided with a connection to the Internet or other information carrying media such that software may be downloaded into the controller. In one embodiment, after software is downloaded, a test procedure is executed to ensure that the software has been properly loaded into the control and the control can function properly. The results of that test procedure may be passed back to a remote location over the Internet or other information carrying media, such that the remote location can verify and ensure that the update has occurred successfully.

As is known, a conventional refrigerant system typically includes a compressor compressing refrigerant and delivering it to a downstream condenser. Refrigerant from the condenser passes through an expansion device, and then to an evaporator. In many refrigerant systems, fans drive air over both the condenser and the evaporator. The controls, including the software, may control any system component such as the compressor, the two fans, and/or the expansion device. Thus, the software updates and test procedures can relate to any combination, or all, of these components.

These and other features of the present invention can be best understood from the following specification and drawings, the following of which is a brief description.

DETAILED DESCRIPTION OF THE PREFERRED EMBODIMENTS

Figure 1:
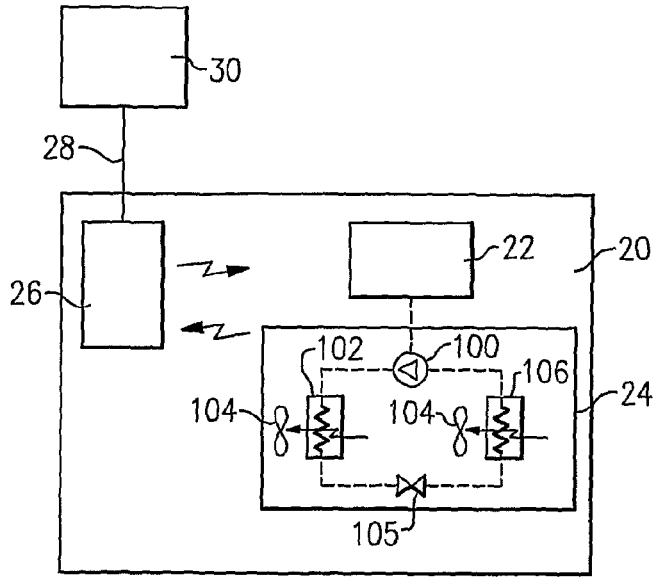
FIG. 1 is a schematic view of the present invention.

A refrigerant system 24 is provided with a controller 22 to condition a conditioned space 20, which may be an indoor environment. The refrigerant system 24 may be an air conditioner or a heat pump, or a chiller, as is known. As an example, refrigerant system 24 can be used to condition an environment within a building, supermarket, refrigerant container unit, truck-trailer unit, etc. An Internet hub such as home computer or router 26 is shown communicating over a remote link to the controller 22. On the other hand, the controller 22 could be hardwired to the computer 26.

As shown, the refrigerant system 24 incorporates a compressor 100 delivering a refrigerant to a condenser 102. A fan 104 blows air over the condenser 102. Refrigerant passes through an expansion device 105, and then to an evaporator 106. Another fan 104 blows air over the evaporator 106. Software for the controller 22 may control any component such as the compressor 100, the fans 104, and the expansion device 105. Further, since a basic refrigerant system configuration is shown in FIG. 1 for illustrative purposes only, other components and features/options may be included into the refrigerant system 24 and controlled by the controller 22. Also, although a refrigerant system 24 is shown in FIG. 1 confined within the conditioned space 20, in reality, it is connected to the indoor environment through the air ducts to deliver air blown over the evaporator 106 to the conditioned space 20.

A remote location 30, which may be the location of the manufacturer of the controller 22, or the refrigerant system 24, or any other control center from which the downloaded or uploaded data is transmitted, is connected to the computer 26 over the Internet or other information caring media such as local area network, wide area network or Intranet 28 via a wireless connection such as a satellite or a land line such as a phone line or a cable (copper, fiber optic, etc.). It should be understood that the remote location 30 can be connected directly to the controller 22 by having a dedicated line.

Figure 2:
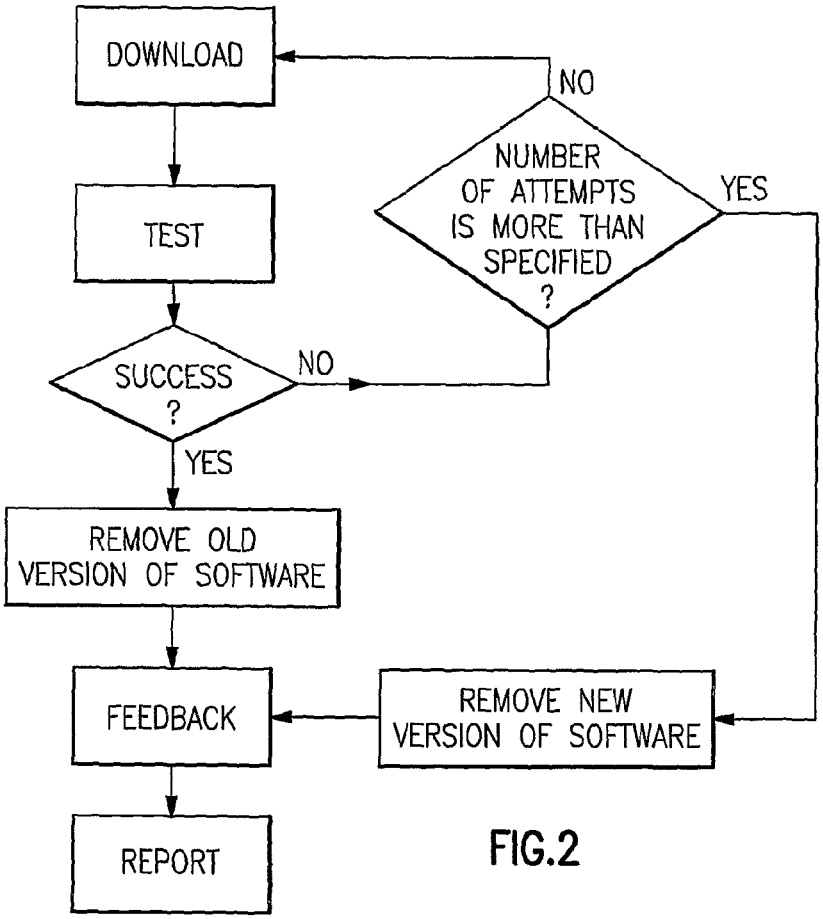
FIG. 2 is a basic flow chart of the present invention.

As shown in the brief flow chart of FIG. 2, when software updates are required, the remote location 30 downloads those updates to the controller 22 over the Internet 28 or other information carrying media. Thus, no maintenance personnel is needed at the conditioned space 20, which may be a location within a building. Once the software has been downloaded into the controller 22, a command to run a test protocol may be initiated. The test may include operation of some components of the refrigerant system 24 associated with the upgrade and determination whether certain changes within the refrigerant system 24 occur which would be expected if the upgrade had been successfully downloaded. For instance, such test procedure can be executed prior to the equipment start-up.

The results of the tests are then communicated back over the Internet 28 or other information carrying media to the remote location 30. The test procedures and the software updates can be related to any of the components controlled by the controller 22, for example, the compressor 100, the fans 104, or the expansion device 105. When the test results are verified to ensure proper operation of the controller 22 and refrigerant system 24, the older version of the software can be removed from the control's memory. In case, the test results have not been successful or are questionable, the older software version may be re-activated. On the other hand, if the error associated with the software download can be corrected (for example, equipment is shutdown for maintenance, network is overloaded at the time of the transmission, power grid is down, etc.), then a re-loading scheme can be devised to attempt software downloading on a timeout basis until it is successful or for a certain number of tries.

In this manner, from the remote location, the manufacturer is able to update the software for the refrigerant system controller 22 and ensure that the upgraded software has been successfully loaded to allow the controller 22 to properly function and operate the refrigerant system 24.

It has to be noted that software upgrades can be executed at convenient time (for instance, at nighttime) when the equipment operation is not in high demand, Internet is not heavily loaded and there is no compromise for the occupant's comfort in the conditioned space.

Although a preferred embodiment of this invention has been disclosed, a worker of ordinary skill in this art would recognize that certain modifications would come within the scope of this invention. For that reason, the following claims should be studied to determine the true scope and content of this invention.

The invention claimed is:

1. A refrigerant system including a plurality of components that are operable to change at least a temperature of a secondary fluid;

a control for controlling said plurality of components, said control being provided with operational software; and a link to a remote location over an information carrying media, said link being operable to provide software upgrades to the control when said software upgrades are required;

wherein said plurality of components includes at least one of a compressor, a heat exchanger having fans or pumps for moving a secondary fluid over the heat exchangers, an expansion device, an air conditioner, a heat pump, and a chiller;

wherein said control is operational to perform a system test after said software upgrade has been downloaded, and to report the results of the system test back to the remote location, said system test including a test of at least one of said plurality of components.

2. The refrigerant system as set forth in claim 1, wherein the information carrying media is one of the Internet, a LAN, a WAN, a secured network or an Intranet.

3. The refrigerant system as set forth in claim 1, wherein said secondary fluid is used to condition an environment within one of a building, house, supermarket, container refrigeration unit, truck-trailer refrigeration unit, or mobile air conditioning unit.

4. The refrigerant system as set forth in claim 1, wherein said link is connected to a computer.

5. The refrigerant system as set forth in claim 4, wherein a connection between said control and said computer is by a wireless connection.

6. The refrigerant system as set forth in claim 1, wherein said plurality of components include at least a compressor, and said software upgrades relate to control of said compressor.

7. The refrigerant system as set forth in claim 6, wherein said system test is performed on said compressor after said software upgrade has been downloaded and results of that system test are reported back to the remote location.

8. The refrigerant system as set forth in claim 1, wherein said plurality of components include at least a plurality of heat exchangers having fans or pumps for moving a secondary fluid over the heat exchangers, and said software upgrades relate to control said fans or pumps.

9. The refrigerant system as set forth in claim 8, wherein said system test is performed after said software upgrade has been downloaded, and that system test includes operating said fans or pumps, with results of the operation of the fans or pumps being reported back to the remote location.

10. The refrigerant system as set forth in claim 1, wherein said plurality of components includes an expansion device, with said software upgrades relating to the control of the expansion device.

11. The refrigerant system as set forth in claim 10, wherein said system test is performed after said software upgrade has been downloaded, and that system test includes operating the expansion device, with results of the operation of the expansion device being reported back to the remote location.

12. The refrigerant system as set forth in claim 1, wherein said link being operable to provide software upgrade during selected time period.

13. The refrigerant system as set forth in claim 1, wherein said link being operable to provide a repeated software upgrade over the information carrying media if the initial software upgrade was not successful.

14. The refrigerant system as set forth in claim 1, wherein the plurality of components includes a compressor, an expansion device, and two fans.

15. The refrigerant system as set forth in claim 14, wherein the two fans are associated with a respective heat exchanger.

16. A method of operating a refrigerant system including the steps of:

(1) providing a plurality of components that are operable to change at least a temperature of a secondary fluid, said components including at least one of an air conditioner, a heat pump or a chiller;

(2) providing a control for controlling said plurality of components, said control being provided with operational software;

(3) linking said control to a remote location over an information carrying media, and providing software upgrades to the control from the remote location;

(4) performing a system test, with said control, after said software upgrade has been downloaded, said system test including a test of at least one of said plurality of components; and (5) reporting the results of the system test back to the remote location.

17. The method as set forth in claim 16, wherein the information carrying media is one of the Internet, a LAN, a WAN, a secured network or an Intranet.

18. The method as set forth in claim 16, wherein said link is connected to a computer.

19. The method as set forth in claim 16, wherein said plurality of components includes at least one of a compressor, an expansion device and a heat exchanger.

20. The method as set forth in claim 19, wherein said heat exchanger includes at least one of a fan and a pump.

21. A method of operating a refrigerant system including the steps of:

(1) providing a plurality of components that are operable to change at least the a temperature of a secondary fluid;

(2) providing a control for controlling said plurality of components, said control being provided with operational software;

(3) linking said control to a remote location over an information carrying media;

(4) determining whether said control requires a software upgrade;

(5) providing software upgrades to the control from the remote location in response to a determination that said control requires a software upgrade;

6) performing a system test, with said control, after said software upgrade has been downloaded, said system test including a test of at least one of said plurality of components, said components including at least one of an air conditioner, a heat pump or a chiller; and (7) reporting the results of the system test back to the remote location.

* * * * *